US007358676B2

(12) United States Patent
Ho

(10) Patent No.: US 7,358,676 B2
(45) **Date of Patent: *Apr. 15, 2008**

(54) FLUORESCENT LIGHT SOURCE

(75) Inventor: Run Lin Ho, Xiamen (CN)

(73) Assignee: Aero Tech Light Bulb Co., Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/331,778

(22) Filed: Jan. 13, 2006

(65) Prior Publication Data

US 2006/0114670 A1 Jun. 1, 2006

Related U.S. Application Data

(63) Continuation of application No. 10/799,466, filed on Mar. 12, 2004, now Pat. No. 7,012,373.

(30) Foreign Application Priority Data

May 26, 2003 (CN) ..... 03222136

(51) Int. Cl.
*H01J 17/16* (2006.01)

(52) U.S. Cl. ..... 313/634; 313/493

(58) Field of Classification Search ..... 313/634, 313/493, 317, 318.01

See application file for complete search history.

(56) References Cited

U.S. PATENT DOCUMENTS 4,677,345 A 6/1987 Nilssen
4,857,806 A 8/1989 Nilssen
5,047,690 A 9/1991 Nilssen
5,128,590 A * 7/1992 Holzer ..... 315/58
5,166,578 A 11/1992 Nilssen
5,191,262 A 3/1993 Nilssen
5,233,270 A 8/1993 Nilssen
5,341,067 A 8/1994 Nilssen
5,343,123 A 8/1994 Nilssen
5,362,246 A 11/1994 Lau
5,424,610 A 6/1995 Pelton et al.
5,446,347 A 8/1995 Nilssen
5,510,680 A 4/1996 Nilssen
5,510,681 A 4/1996 Nilssen
5,552,666 A 9/1996 Shea et al.

(Continued)

FOREIGN PATENT DOCUMENTS

DE 19525624 2/1996

(Continued)

OTHER PUBLICATIONS

DURA Lamp, product literature, Jan. 2004.

(Continued)

*Primary Examiner*—Nimeshkumar D. Patel
*Assistant Examiner*—Christopher M. Raabe
(74) *Attorney, Agent, or Firm*—Bell, Boyd & Lloyd

(57) ABSTRACT

A fluorescent light source includes at least one tube surrounding an interior region. The tube has a plurality of tubular portions, each one of which is disposed adjacent to at least one other tubular portion. The fluorescent light source has a support member, and each one of the tubular portions is configured to extend vertically from the support member and to curve outwardly away from the interior region.

30 Claims, 6 Drawing Sheets

U.S. PATENT DOCUMENTS

| | | | | |
|---|---|---|---|---|
| 5,569,981 | A | 10/1996 | Cho | |
| 5,629,586 | A | 5/1997 | Yasuda et al. | |
| 5,672,932 | A * | 9/1997 | Goldman | 313/318.01 |
| 5,703,440 | A * | 12/1997 | Kachmarik et al. | 315/56 |
| 5,757,140 | A | 5/1998 | Nilssen | |
| 6,064,155 | A | 5/2000 | Maya et al. | |
| 6,172,464 | B1 | 1/2001 | Nilssen | |
| 6,211,625 | B1 | 4/2001 | Nilssen | |
| D466,630 | S | 12/2002 | Bobel | |
| D466,631 | S | 12/2002 | Bobel | |
| D468,845 | S | 1/2003 | Bobel | |
| D469,548 | S | 1/2003 | Bobel | |
| D469,549 | S | 1/2003 | Bobel | |
| D469,891 | S | 2/2003 | Bobel | |
| D469,892 | S | 2/2003 | Bobel | |
| D470,254 | S | 2/2003 | Bobel | |
| D470,605 | S | 2/2003 | Bobel | |
| D470,609 | S | 2/2003 | Bobel | |
| D471,293 | S | 3/2003 | Bobel | |
| D471,294 | S | 3/2003 | Bobel | |
| D471,295 | S | 3/2003 | Bobel | |
| D471,651 | S | 3/2003 | Bobel | |
| 7,012,373 | B2 * | 3/2006 | Ho | 313/634 |
| 2002/0101164 | A1 | 8/2002 | Yan | |
| 2002/0167263 | A1 | 11/2002 | Nishio et al. | |
| 2003/0001504 | A1 | 1/2003 | Yu | |
| 2003/0002283 | A1 | 1/2003 | Marian et al. | |
| 2003/0080691 | A1 | 5/2003 | Yasuda et al. | |

FOREIGN PATENT DOCUMENTS

| | | |
|---|---|---|
| DE | 19614071 | 10/1996 |
| DE | 19963278 | 7/2000 |
| EP | 0652691 | 5/1995 |
| FR | 2657147 | 7/1991 |
| JP | 5089831 | 4/1993 |
| JP | 6267505 | 9/1994 |
| JP | 6290746 | 10/1994 |
| JP | 8203470 | 8/1996 |
| JP | 10326594 | 12/1998 |
| JP | 11273422 | 10/1999 |
| JP | 2000067812 | 3/2000 |
| JP | 2001068058 | 3/2001 |
| JP | 2001068059 | 3/2001 |
| JP | 2001068060 | 3/2001 |
| JP | 2002008402 | 1/2002 |
| JP | 2002083505 | 3/2002 |
| JP | 2002110095 | 4/2002 |
| JP | 2002203512 | 7/2002 |
| JP | 2002289143 | 10/2002 |
| JP | 2002298785 | 10/2002 |
| JP | 2003059452 | 2/2003 |
| WO | WO9425978 | 11/1994 |
| WO | WO03043055 | 5/2003 |

OTHER PUBLICATIONS

GE Lighting Lamp Products Catalog 2004, pp. 5-3, 5-10, and 5-11, Jan. 2004.

MaxLite™ Brochure, prior to Jun. 2004.

MaxLite™ Brochure, Jun. 2004.

Phillips Lighting Company, Lamp Specification & Application Guide 2004, pp. 13 and 43-54, Jan. 2004.

Sylvania, Lamp and Ballast Product Catalog 2004, pp. 103 and 111-112, Jan. 2004.

Technical Consumer Products, Inc., Commercial/Industrial Lamps & Fixtures, Brochure, Feb. 2004.

Westinghouse 2002 Lamp Specification Guide, pp. 55-56, Jan. 2002.

* cited by examiner

FIG. 1A
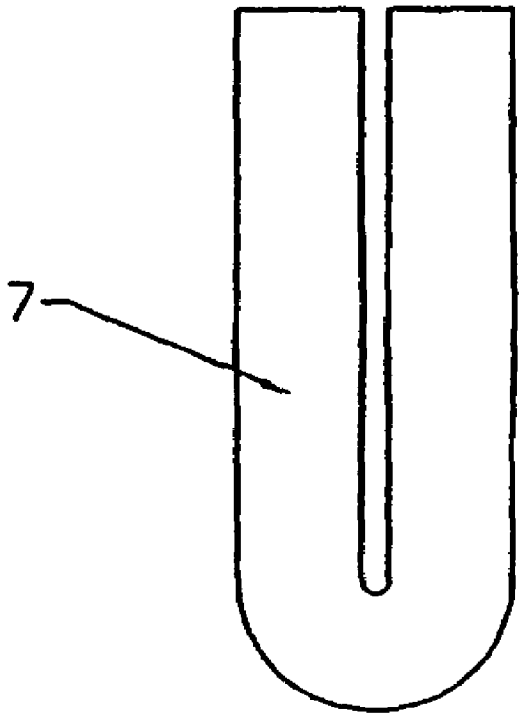
FIG. 1B
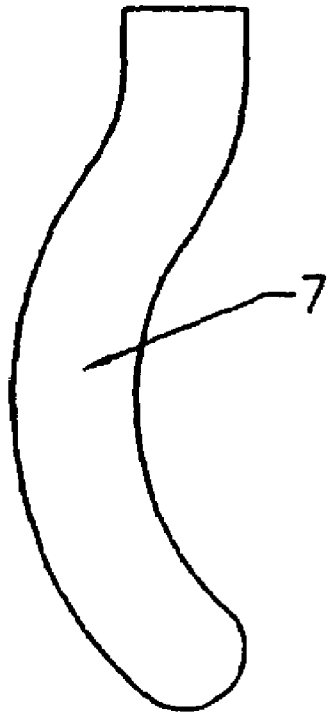
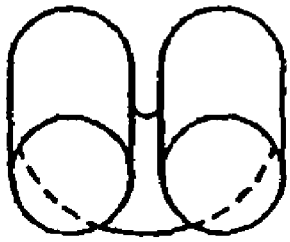
FIG. 1C

FIG. 2A
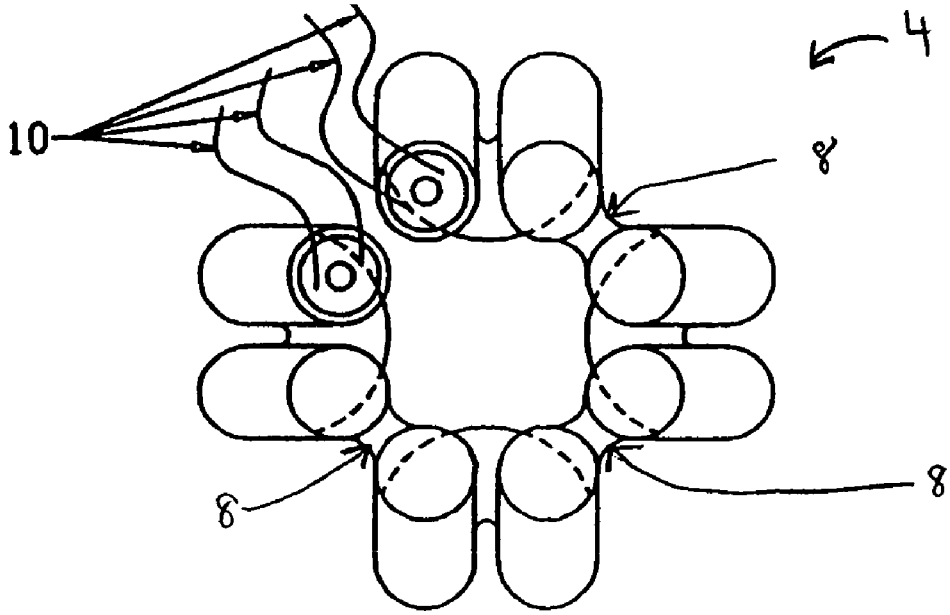
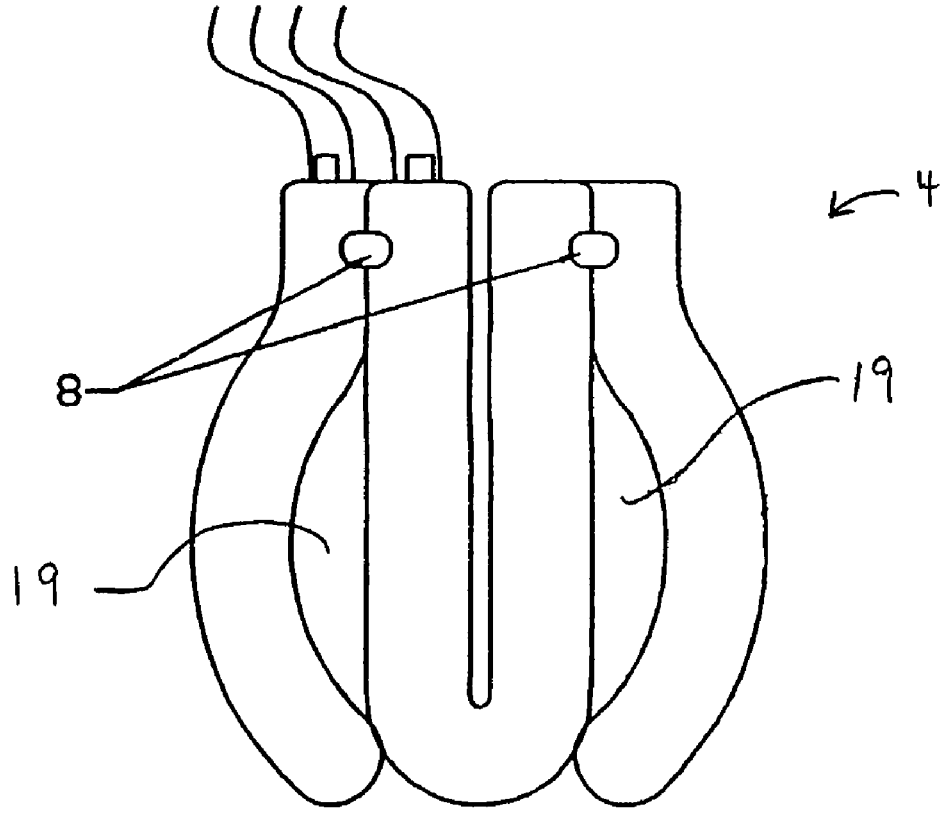
FIG. 2B

FIG. 3A
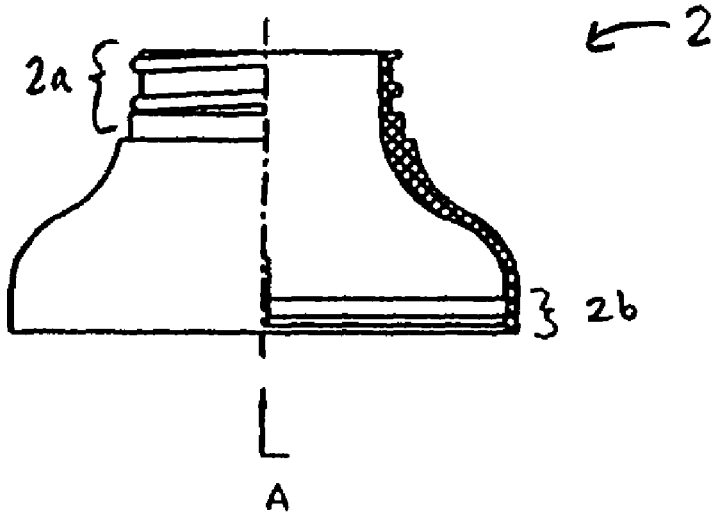
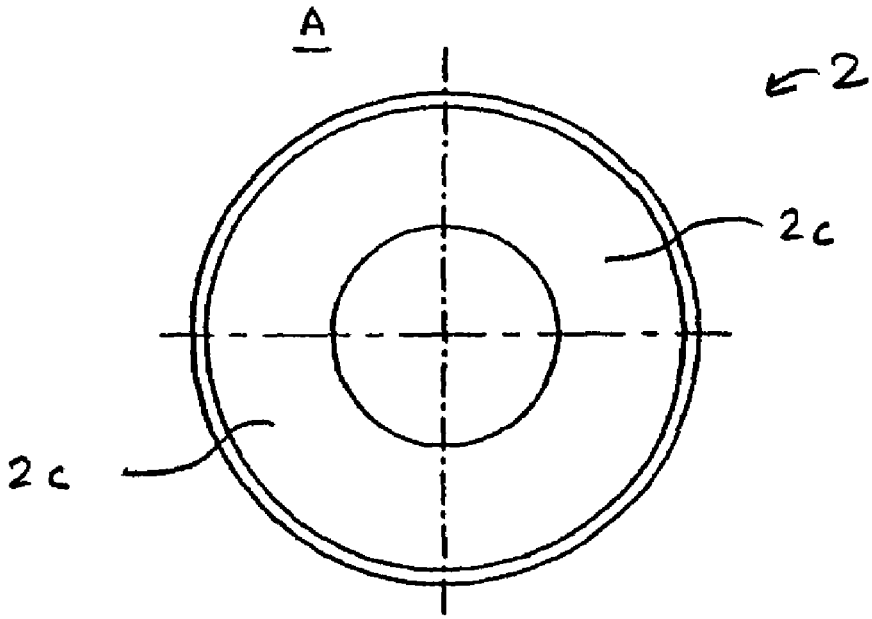
FIG. 3B

FIG. 4A
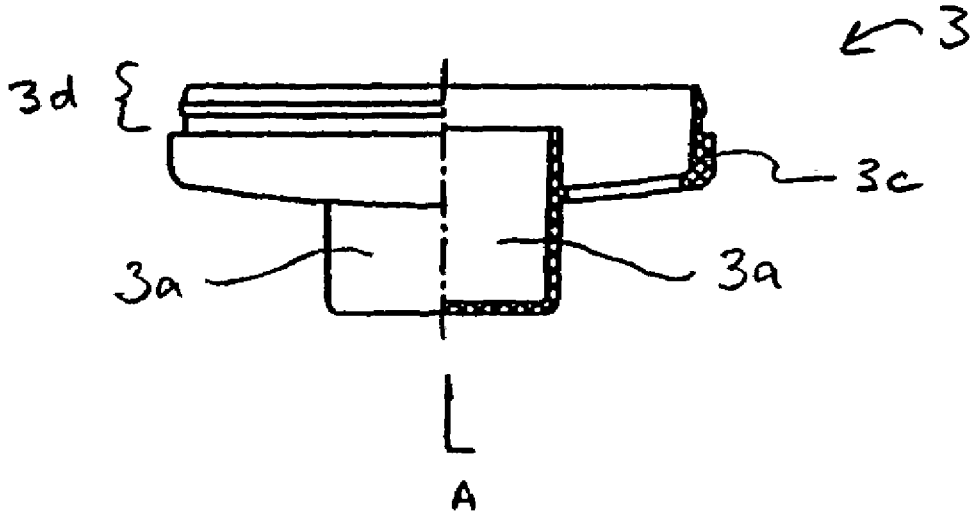
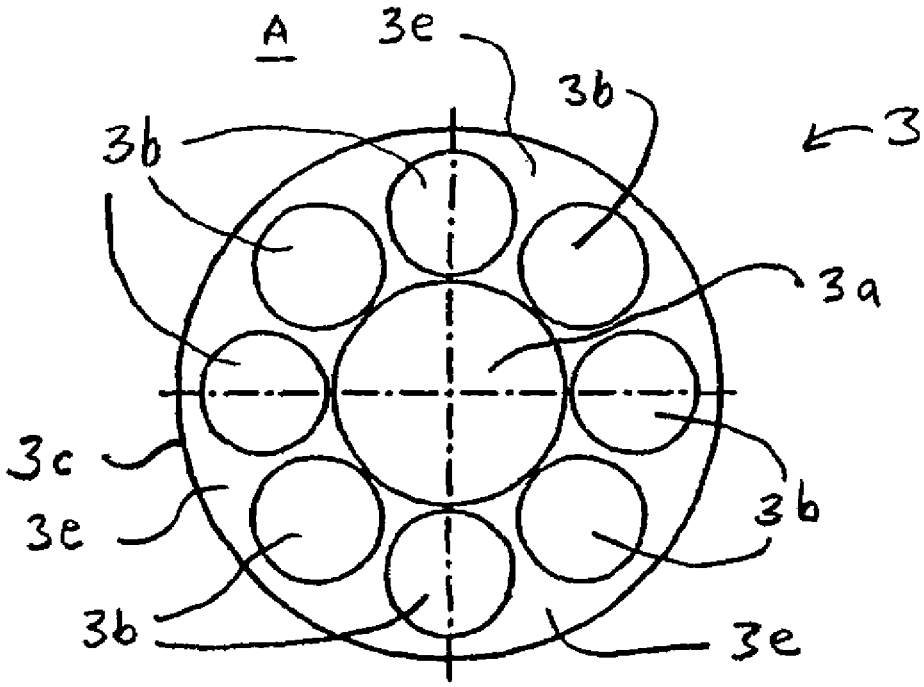
FIG. 4B

FLUORESCENT LIGHT SOURCE

PRIORITY CLAIM

This application is a continuation of and claims priority to and the benefit of U.S. patent application Ser. No. 10/799,466, filed on Mar. 12, 2004 now U.S. Pat. No. 7,012,373 and entitled "Electronic Energy-Saving Fluorescent Lamp of Ultra-Short Chayote-Shaped Compact Type," which, in turn, claims priority to Chinese Patent Application No. CN03222136.3, filed May 26, 2003, entitled "Ultra-Short Chayote-Like Compact Electronic Energy-Saving Fluorescent Lamp."

BACKGROUND OF THE INVENTION

This utility model relates to illuminating lamps, in particular to an ultra-short Chayote-like compact electronic energy-saving fluorescent lamp.

The existing compact electronic energy-saving fluorescent lamps (hereinafter referred to as CFL) with medium and low power smaller than 24 W have basically a column structure in their structural configuration, e.g., U-shape, N-shape, H-shape, the shape of double screw bolt, etc. These existing CFL's have a cylindrical source of light in common, meanwhile the lower cover used to secure the luminous tube in these lamps is of planar construction. The electronic ballast is usually assembled by separate type components. These separate type components (including a current limiting inductor with larger size occupying relatively larger space) are totally mounted on the component side of the Printed Circuit Board (PCB), making the upper and lower covers for receiving the electronic ballast have larger size. Therefore, such a CFL has many disadvantages. One of the disadvantages is the light utilization rate is much lower because the light sent out from the inside surface of the luminous tube is kept out by the near and the opposite luminous tubes. Another disadvantage is the heat generated by the luminous tubes is difficult to be emitted because the luminous tubes of the fluorescent lamp are abutted against one another. Thus, a considerable amount of heat is accumulated, resulting in too high temperature in the working area of the luminous tube and the luminous efficiency is reduced. An additional disadvantage is the luminous tube is longer.

SUMMARY OF THE INVENTION

Based on the full analysis of the CFL's with power smaller than 24 W, the present invention eliminates or decreases their deficiencies, provides solutions for solving these problems and implements the corresponding technical measures which, in one embodiment, results in a Chayote-like compact electronic energy-saving fluorescent lamp (hereinafter referred to as Chayote-like lamp).

In one embodiment, the Chayote-like lamp comprises a base, an upper cover, a lower cover, a luminous tube combination or luminous tube and an electronic ballast. The luminous tube is formed by bridge connection of several luminous tubes. The current limiting inductor of the electronic ballast is welded and assembled on the face of the weld of the Printed Circuit Board (PCB). A cylindrical cavity protrudes downward from the bottom center of the lower cover, characterized in that said Chayote-like lamp is formed by assembling several Chayote-like lamp units—finger-shaped luminous tubes bent so as to have a certain curvature and uniformly distributed about the lamp axis. The current limiting inductor welded and assembled on the face of the weld of the Printed Circuit Board (PCB) is placed in a cylindrical cavity protruding downward from the bottom center of the lower cover.

There are several beneficial effects of the present invention. One beneficial effect is that pulling apart the gap (identified in the figures as gap 19) between each unit luminous tube (about six times or more than that of the column structure) causes the light sent out from the inside of the luminous tube to be directly sent out through the adjacent gaps and the opposite gaps. Thereby, the light utilization rate is greatly improved. Another beneficial effect is that, for each unit U-shaped luminous tube of the Chayote-like lamp, the U-shaped luminous tube is bent at a certain curvature into a finger shape. Thereby, the length of the luminous tube is shortened. The length of the luminous tube of the Chayote-like lamp is much shorter compared to the columnar luminous tube with the same power.

Yet another beneficial effect of the present invention is that the cylindrical cavity protrudes downward from the bottom of the lower cover in the Chayote-like lamp for receiving the current limiting inductor. This configuration shortens the length of the upper cover on the basis of decreasing the length of the electronic ballast.

Still another beneficial effect is that the gap between the unit luminous tubes of the Chayote-like lamp becomes larger, which results in sufficient heat emission and lowers the temperature in the working area of the luminous tube. Thus the luminous efficiency of the Chayote-like lamp is greatly improved. Meanwhile, the temperature rise of the electronic ballast can be reduced and thus, the reliability of the Chayote-like lamp is improved, and its service life is prolonged.

The aforementioned and the other objects, features and advantages of the present invention, to those skilled in the art, will be better understood with regard to the following Detailed Description and accompanying figures.

BRIEF DESCRIPTION OF THE FIGURES

FIG. 1A is a front elevation view of one of the finger-shaped unit luminous tubes of the luminous tube combination or luminous tube in one embodiment of the present invention.

FIG. 1B is a side elevation view of the finger-shaped luminous tube of FIG. 1A.

FIG. 1C is a top or plan view of the finger-shaped luminous tube of FIG. 1A.

FIG. 2A is a top or plan view of the luminous tube combination or luminous tube in one embodiment of the present invention.

FIG. 2B is a side elevation view of the luminous tube combination or luminous tube of FIG. 2A.

FIG. 3A is a side elevation view of the upper cover of the lamp in one embodiment of the present invention.

FIG. 3B is a bottom view of the upper cover of FIG. 3A.

FIG. 4A is a side elevation view of the lower cover of the lamp in one embodiment of the present invention.

FIG. 4B is a bottom view of the lower cover of FIG. 4A.

DETAILED DESCRIPTION OF THE INVENTION

Figure 5A:
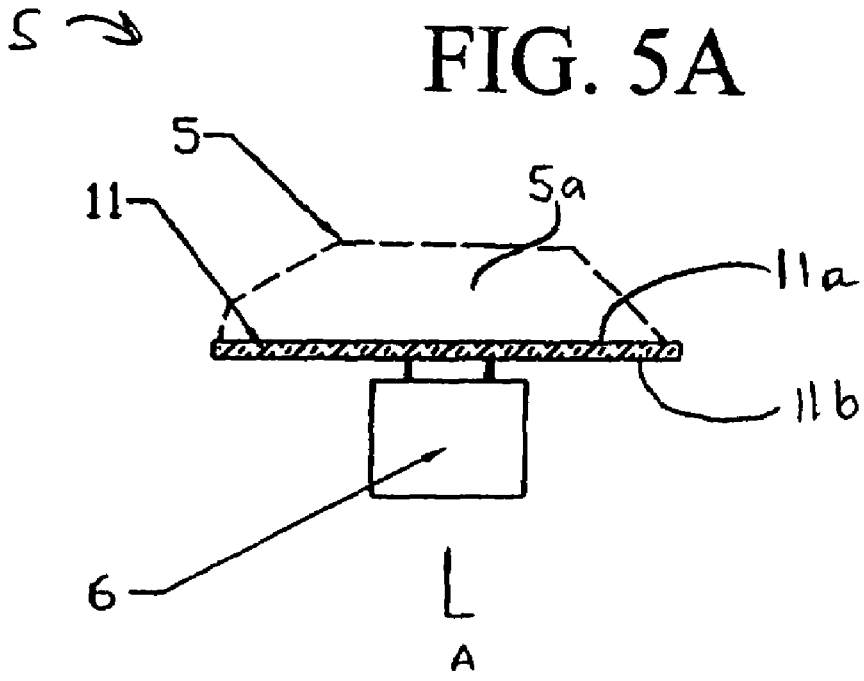
FIG. 5A is a diagrammatic side elevation view of the electronic ballast of the lamp in one embodiment of the present invention.
Figure 5B:
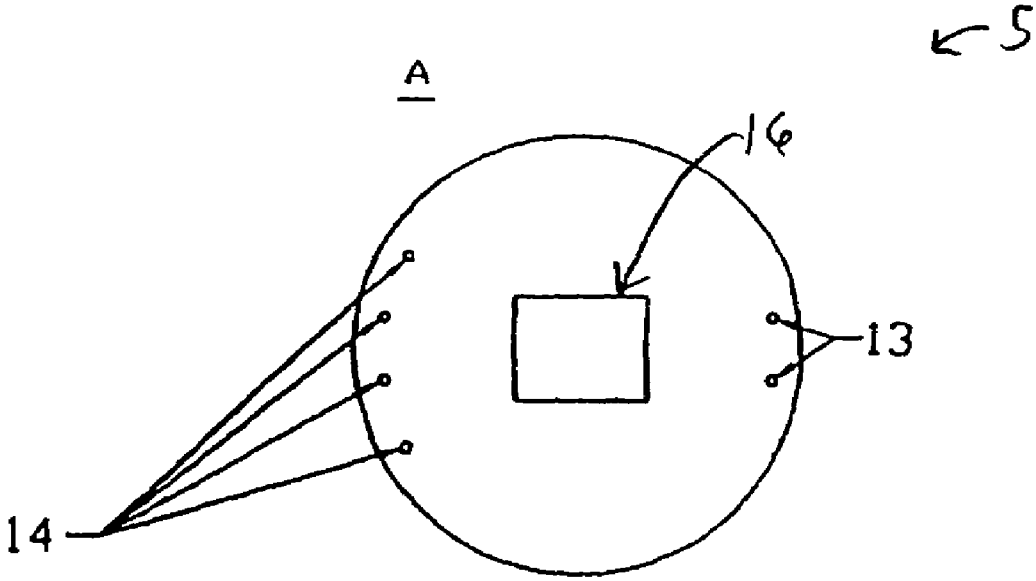
FIG. 5B is a bottom view of the electronic ballast of FIG. 5A.

Referring now to FIGS. 1A-2B, in one embodiment, the luminous tube combination or luminous tube 4 of the lamp 18 (illustrated in FIGS. 6A-6B) is the combination of several unit luminous tubes 7. Each unit luminous tube 7 is formed by bending a U-shaped tube at certain curvature into a finger-shaped unit luminous tube 7 and building up the finger-shaped unit luminous tubes 7 according to the shape of Chayote. According to the different requirements to the designed unit luminous tubes 7, two to five finger-shaped unit luminous tubes 7 with the same curvature are connected in a manner of bridge connection to form a fluorescent lamp with the shape of a Chayote. The tube diameter of the finger-shaped unit luminous tube 7 is in the range of eight to eleven millimeters. The finger-shaped unit luminous tubes 7 are connected to one another in the sequence of connection bridge 8. The filaments 9 (illustrated in FIG. 6B) are cased in both the beginning and the end finger-shaped unit luminous tubes 7, meanwhile rare earth tricolor phosphor powder is uniformly coated on the inner walls of all the finger-shaped unit luminous tubes 7. Also, a certain amount of mercury and inert gas is filled in the luminous tube combination or luminous tube 4 of the Chayote-like lamp 18.

As illustrated in FIGS. 3A-3B, the lamp 18 has an upper cover 2 in one embodiment of the present invention. The upper cover 2 is of a horn shape. There is external thread structure 2*a* on its upper half section and there is annular key and groove structure 2*b* inside of the lower section. The external thread 2*a* is used for connecting and securing the base 1. The key and groove structure 2*b* is used for the mechanical connection of upper cover 2 to lower cover 3. The inner cavity 2*c* of the upper cover 2 is used for receiving electronic ballast 5.

As illustrated in FIGS. 4A-4B, the lamp 18 also has a lower cover 3 in one embodiment of the present invention. The lower cover 3 is of a funnel shape. A cylindrical cavity 3*a* is protruded downward from its bottom center. Eight (or four or six or ten) circular through holes 3*b* are distributed around the cavity 3*a*. A circular peripheral border 3*c* with certain thickness of the lower cover 3 is provided on the outmost edge. Annular key and groove 3*d* are located on the upper part of the peripheral border 3*c*. The protruded cylindrical cavity 3*a* is used for placement of current limiting inductor 6. The circular through holes 3*b* are used for mounting and securing the luminous tube of the Chayote-like lamp 18. The portion 3*e* between the peripheral border 3*c* and the cavity 3*a* is used for filling the securing glue. The annular key and groove 3*d* is used for the mechanical connection to the upper cover 2.

In one embodiment, the lamp 18 also includes an electronic ballast 5, as illustrated. The electronic ballast 5 comprises a Printed Circuit Board (PCB) 11, current limiting inductor 6 and several resistors, capacitors, diodes, triodes, etc. (not shown). As illustrated in FIG. 6B, a plane 21 extends through the PCB 11 and the cover 3. The upper surface 11*a* of the PCB 11 is the face of component and its lower surface 11*b* is the face of weld. The electronic ballast 5 defines a space 5*a* for positioning the resistors, capacitors, diodes, triodes, etc. These components are welded and assembled on the face 11*a* of component 11. The current limiting inductor 6 is welded and assembled on the face 11*b* of the weld. In the embodiment illustrated in FIG. 6B. the inductor 6 extends less than twenty-five percent (and therefore less than fifty percent) of the distance (D) from the plane 21 to the end 23 of the luminous tubes 7. In addition, two input junction points 13 and four output junction points 14 are also disposed on PCB 11. The input junction points 13 are electrically connected to power supply connecting wire 12 so as to provide the AC power supply to the electronic ballast 5. The four output junction points 14 are electrically connected to the filament outlet 10 of the luminous tube combination or luminous tube 4 of the Chayote-like lamp 18 so as to provide high frequency voltage and current to the luminous tube combination or luminous tube 4 of the Chayote-like lamp 18 and two sets of filaments 9.

Figure 6A:
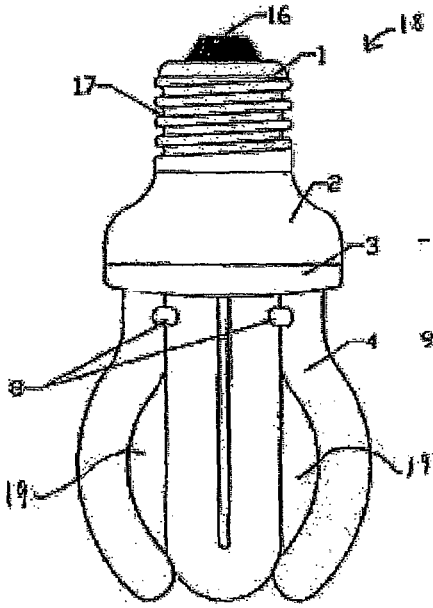
FIG. 6A is a side elevation view of the lamp in one embodiment of the present invention.
Figure 6B:
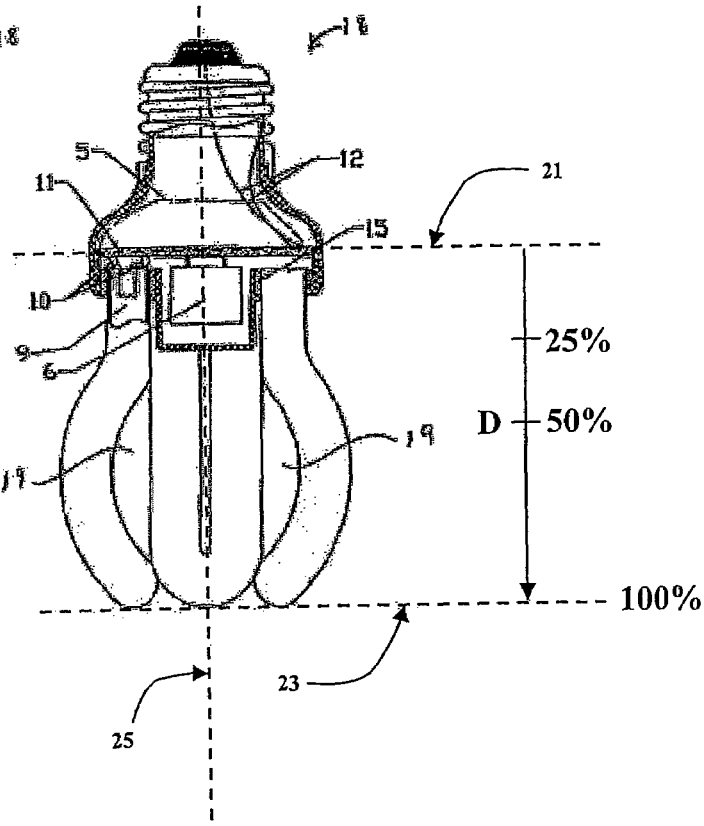
FIG. 6B is a side elevation view of the lamp diagrammatically illustrating the inner components of the lamp in one embodiment of the present invention.

As illustrated in FIGS. 6A and 6B, in one embodiment the Chayote-like lamp 18 includes a base 1, an upper cover 2, a lower cover 3, a luminous tube combination 4 of the Chayote-like lamp 18 and an electronic ballast 5. Their connection is divided into electrical connection and mechanical connection. The electrical connection includes the electrical connection of one end of the two power supply connecting wires 12 of the base 1 to the center point of the base 1 and the thread portion 17, respectively. The thread portion 17 extends along an axis 25. The electrical connection also includes the other end of the wires 12 being connected to the two input junction points 13, respectively. In this electrical connection, the four output junction points 14 on PCB 11 are connected to the terminals of the four filament outlets 10 of the Chayote-like lamp 18.

The mechanical connection of the lamp 18 includes: (a) the connection of base 1 to upper cover 2; (b) the connection of lower cover 3 to the luminous tube combination or luminous tube 4 of the Chayote-like lamp 18; and (c) the connection of upper cover 2 to lower cover 3 after the electrical connection. In the case of (a), the base 1 and upper cover 2 are connected by thread and clasped after they are screwed down. In the case of (b), the upper one end of the luminous tube combination 4 of the Chayote-like lamp 18 is inserted into the circular through holes 3*b* of the lower cover 3 and their joint is fixed using securing glue. In the case of (c), this connection is located in the cylindrical cavity formed after the current limiting inductor 6 is placed into the lower cover 3. The electronic ballast 5 falls into the lower cover 3 and, at the same time, the upper cover 2 is used to cover the electronic ballast 5. The upper cover 2 and the lower cover 3 are tightly connected to one another through annular key groove.

Because the luminous tube combination 4 of the present invention has a shape of a Chayote, a cylindrical cavity is protruded from the center of the bottom of the lower cover 3 towards the direction of the luminous tube combination or luminous tube 4. The current limiting inductor 6 is welded and assembled on the face 11*b* of weld of the PCB board 11. The special structures mentioned above bring the Chayote-like lamp advantages e.g., novel structure, ultra-short size, small and exquisite, higher luminous efficiency, higher reliability, longer service life and wide application for the illumination in all places, particularly suitable for the lamps and lanterns with covers.

The foregoing example is only used for the description of the present invention, other than the limit to the present invention. To those skilled in the art, variations or modifications can be made without departing from the spirit and the range of the present invention. Therefore, all equivalent technical solutions shall belong to the category of the present invention and shall be covered by the claims.

The following is a list of terms used herein and the identification numbers corresponding to such terms:

base 1
upper cover 2
lower cover 3
luminous tube combination or luminous tube 4 (of the lamp 18)
electronic ballast 5
current limiting inductor 6
finger-shaped unit luminous tube 7
connection bridge 8
filament 9
filament outlet 10
Printed Circuit Board (PCB) 11
power supply connecting wire 12
input junction point 13
output junction point 14
connection securing glue 15
center point 16 (of the base 1)
thread 17 (of the base 1)
Chayote-like lamp 18
gap 19

The invention is claimed as follows:

1. A fluorescent light source comprising: a tube surrounding an at least partially spherical interior region, the tube having a plurality of tubular portions, each one of the tubular portions disposed adjacent to at least one other tubular portion, and each one of the tubular portions configured to be in fluid communication with the at least one other tubular portion;

a support member having: (a) a first side facing part of the interior region; and (b) a second side positioned opposite the first side, each one of the plurality of tubular portions configured to extend vertically from the support member beyond the first side and to curve radially outward to define at least a portion of the at least partially spherical interior region, each one of the tubular portions having an end located a substantially identical distance from the support member and separated a distance from the other ends of the tubular portions;

a housing coupled to the support member, the housing extending beyond the second side, the housing defining a space; and a ballast supported by the support member, the ballast having a plurality of portions including: (a) a circuit board, a portion of the circuit board being positioned within the space; (b) at least one circuit part coupled to the circuit board, the circuit part positioned within the space; and (c) an inductor, at least part of the inductor being positioned within the interior region, the inductor extending less than fifty percent of the distance beyond the support member.

2. The fluorescent light source of claim 1, wherein each one of the plurality of tubular portions has:

(a) a first end mounted to the support member; and (b) a second end disposed at an angle of at least approximately 45° relative to the second end of the at least one other tubular portion.

3. The fluorescent light source of claim 1, wherein the circuit part includes a part selected from the group consisting of a resistor, a capacitor, a diode and a triode.

4. The fluorescent light source of claim 1, wherein: (a) the housing has a conical shape; (b) the circuit board is mounted to the second side of the support member; and (c) the ballast has a plurality of circuit parts positioned within the space.

5. The fluorescent light source of claim 3, which includes a connector which mounts the inductor to the circuit board, the mounted inductor being positioned within the space.

6. The fluorescent light source of claim 5, which includes a screw portion coupled to the housing.

7. The fluorescent light source of claim 1, wherein the tube is a plurality of individual tubes interconnected together.

8. The fluorescent light source of claim 1, wherein the tube is a single, integral structure.

9. The fluorescent light source of claim 1, wherein the tube has a pear-shaped configuration.

10. The fluorescent light source of claim of claim 1, which includes a coupler connected to the support member, the coupler enabling the housing to be coupled to the support member.

11. The fluorescent light source of claim 5, wherein the inductor extends less than twenty-five percent of the distance beyond the support member.

12. The fluorescent light source of claim 1, which includes a plurality of tubular connectors which fluidly connect the tubular portions together, the tubular connectors being positioned adjacent to the first side of the support member.

13. The fluorescent light source of claim 1, wherein each of the tubular portions include at least two terminating portions coupled to the support member.

14. A compact fluorescent light source, a top portion of which has a spherical shape, the compact fluorescent light source comprising:

a support;

a plane passing through the support, the plane having a first side and a second side positioned opposite the first side;

a plurality of tubular members each having: (a) a first end including at least two terminating portions coupled to the support; and (b) a second end positioned beyond the first side of the plane, the tubular members configured to define at least part of the spherical shape;

a housing coupled to the support, the housing defining an area positioned beyond the second side;

a circuit coupled to the support, the circuit having a plurality of circuit components, a plurality of the circuit components positioned within the area of the housing;

at least one inductor coupled to the circuit, the inductor positioned beyond the first side of the plane; and a screw portion coupled to the housing, the screw portion electrically coupled to the circuit.

15. The compact fluorescent light source of claim 14, which includes a cover coupled to the support, the cover covering the inductor.

16. The compact fluorescent light source of claim 14, wherein the spherical structure has a pear-shaped configuration.

17. The compact fluorescent light source of claim 14, wherein the spherical structure is one of a plurality of individual tubes interconnected together or a single, integral structure.

18. The compact fluorescent light source of claim 14, wherein each of the tubular members include a middle region between the first end and the second end, the middle region protruding radially outward beyond the first end and the second end.

19. The compact fluorescent light source of claim 18, wherein the middle regions of the tubular members define at least part of the spherical shape.

20. The compact fluorescent light source of claim 14, wherein the tubular members are in fluid communication with one another.

21. A fluorescent light source comprising:

a support member having a first side and a second side positioned opposite the first side;

a plurality of tube members which are fluidly connected to each other, each one of the tube members having at least one curvature and at least two terminating portions coupled to the support member so as to surround an at least partially spherical first space, the at least partially spherical first space extending from the first side of the support member;

a housing coupled to the support member, the housing defining a second space extending from the second side of the support member;

a screw connector coupled to the housing; and a ballast supported by the support member, the ballast having:

(a) a first portion positioned within the first space, the first portion of the ballast including: (i) an inductor; and (ii) another housing which houses the inductor; and (b) a second portion including a circuit board coupled to the second side of the support member, the circuit board having at least one circuit component positioned within the second space.

22. The fluorescent light source of claim 21, wherein each one of the tube members has an end, there being a distance from the first side to the ends, the inductor extending from the first side, less than fifty percent of the distance.

23. The fluorescent light source of claim 21, wherein each of the tube members include a middle region protruding radially outward beyond the terminating portions.

24. A fluorescent light source comprising:

a support member having a first side and a second side positioned opposite the first side;

a plurality of tube members which are fluidly connected to each other, each one of the tube members having at least one curvature, each of the tube members having at least two terminating portions coupled to the support member so as to surround an at least partially spherical first space, the first space extending from the first side of the support member, each one of the tube members extending a substantially identical distance from the first side of the support member;

a housing coupled to the support member, the housing defining a second space extending from the second side of the support member;

a screw connector coupled to the housing; and a ballast supported by the support member, the ballast having:

(a) a first portion positioned within the first space, the first portion of the ballast extending into the first space less than fifty percent of the distance, the first portion of the ballast occupying part of the first space, leaving another part of the first space unoccupied, the unoccupied part of the first space facilitating a transfer of heat away from the tube members when the tube members are outputting light, the transfer of heat being associated with an increased level of efficiency; and (b) a second portion including a circuit board coupled to the second side of the support member, the circuit board having at least one circuit component positioned within the second space.

25. The fluorescent light source of claim 24, wherein the first portion extends into the first space less than twenty five percent of the distance.

26. A fluorescent light source comprising:

(a) a base having:

(i) a screw connector extending along an axis, and (ii) a housing coupled to the screw connector, the housing defining a housing space through which the axis extends;

(b) a plurality of arched tubes coupled to the base so as to extend from the base and surround an at least partially spherical different space through which the axis extends, each of the arched tubes having a middle portion that arches radially outward from the axis to surround at least a portion of the different space;

(c) a circuit supported by the base, the circuit having at least one circuit component positioned within the housing space; and (d) at least one electrical device operable to regulate electrical current, a substantial portion of the electrical device being positioned within at least part of the different space.

27. The fluorescent light source of claim 26, which includes a plurality of tubular connectors which fluidly connect the arched tubes together.

28. The fluorescent light source of claim 26, wherein the electrical device includes an inductor.

29. The fluorescent light source of claim 26, wherein the circuit includes a circuit board.

30. The fluorescent light source of claim 26, wherein each of the arched tubes includes at least two terminating portions coupled to the base.

* * * * *